US006012467A

United States Patent [19]

Kelsey

[11] Patent Number: 6,012,467

[45] Date of Patent: Jan. 11, 2000

[54] PONYTAIL THREADER

[75] Inventor: Martha Kelsey, Fairfield, Iowa

[73] Assignee: Nandi, Inc., Fairfield, Iowa

[21] Appl. No.: 09/192,354

[22] Filed: Nov. 16, 1998

[51] Int. Cl.[7] ..... A45D 8/06; A45D 8/04; A45D 8/00; A45D 8/08

[52] U.S. Cl. ..... 132/280; 132/273; 132/276; 132/284

[58] Field of Search ..... 132/280, 276, 132/284, 273, 242, 275, 264, 223, 282, 281, 283

[56] References Cited

U.S. PATENT DOCUMENTS

| | | | |
|---|---|---|---|
| 1,330,802 | 2/1920 | Greenbowe | 132/280 |
| 1,371,086 | 3/1921 | Hanke | 132/280 |
| 1,485,284 | 2/1924 | O'brien | 132/280 |
| 1,854,793 | 4/1932 | Hermsdorf | 132/280 |
| 3,066,685 | 12/1962 | Sawyer | 132/280 |
| 5,590,670 | 1/1997 | Allred | 132/273 |

*Primary Examiner*—John J. Wilson
*Assistant Examiner*—Rubyn K. Doan
*Attorney, Agent, or Firm*—James C. Nemmers

[57] ABSTRACT

A threading device that is used to create a wrapped ponytail look. The device is a somewhat U-shaped pin of narrow resilient material wide in the middle and narrow at the open end. After the hair strands are wrapped, the device is used to thread the ends of the wrapped hair strands through the inside of the ponytail to hold it in place, after which the threader is removed.

2 Claims, 1 Drawing Sheet

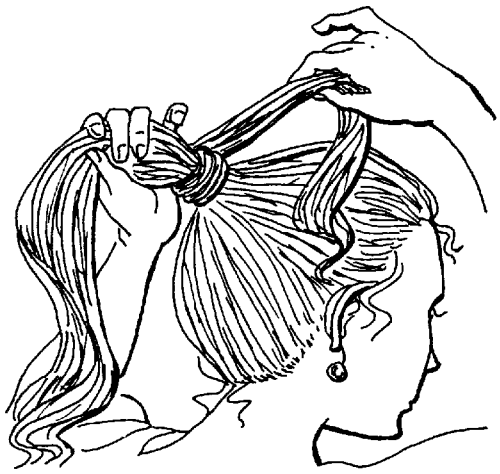
FIG. 2
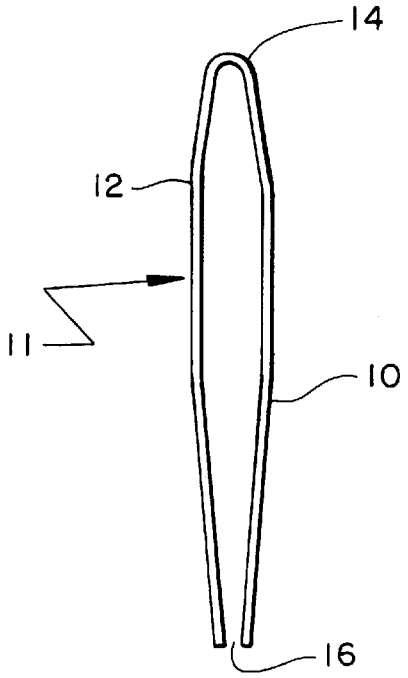
FIG. 1
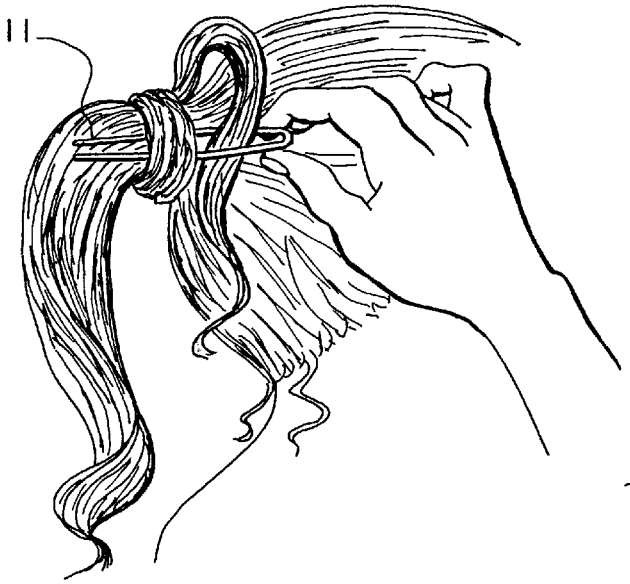
FIG. 3
FIG. 4
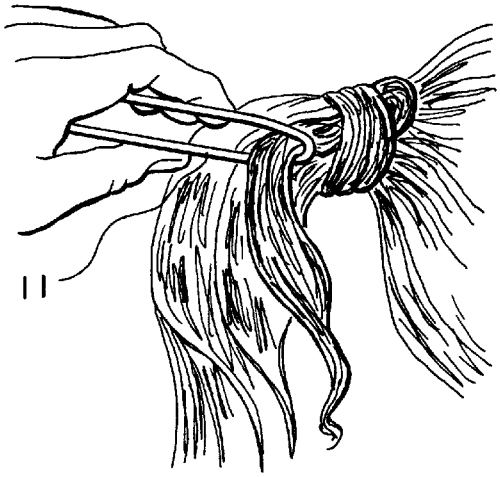

PONYTAIL THREADER

BACKGROUND OF THE INVENTION

Recently, ponytails have become a more popular hair style, especially the "wrapped" ponytail. The wrapped ponytail is also commonly used by women while participating in athletic events in order to prevent the hair from interfering with vision as they perform.

Commonly, women create a ponytail by grasping the hair at the rear of the head pulling it together and then placing an elastic band around it. For a wrapped ponytail, a section of the ponytail hair is then wrapped around the elastic band to cover it, and the wrap is held in place with several bobby pins. With this technique, the bobby pins will be visible, and they also may fall out.

There is therefore a need for a new method and device that can be used to produce the wrapped ponytail look without the use of bobby pins or other types of pins to hold the wrapped strands in place.

SUMMARY OF THE INVENTION

The invention relates to a threading device that is used to create the wrapped ponytail look. The device is a somewhat U-shaped pin of narrow resilient material wide in the middle and narrow at the open end. The device is then used to thread the ends of the wrapped hair strands through the inside of the ponytail to hold it in place, after which the threader is removed.

BRIEF DESCRIPTION OF THE DRAWING

FIG. 1 is a plan view of the ponytail threader of the invention;

FIG. 2 is a view illustrating the first step in creating a ponytail;

FIG. 3 is a view illustrating the first step in using the threader of the invention to create a wrapped ponytail; and FIG. 4 is a view illustrating the second step in using the threader of the invention to create a wrapped ponytail.

DESCRIPTION OF THE PREFERRED EMBODIMENT OF THE INVENTION

Referring first to FIG. 1, there is illustrated the threader 11 of the invention which is made of a continuously length of material formed into a generally U-shaped device having a first leg 10 and a second leg 12. The legs 10 and 12 are joined at one end to form a loop 14 and are open at the end 16 opposite the loop 14. The threader 11 is preferably made of spring steel so that it has not only strength, but resiliency and will not lose its shape during repeated use. As best seen in FIG. 1, the area between the two legs 10 and 12 is wider throughout the middle of the threader 11, and then legs 10 and 12 converge toward each other to form a narrow open end 16. It is essential that the threader 11 be wider in the middle and that the loop 14 be wider than the open end 16 so that the threader 11 can accommodate varying thicknesses of hair. The open end 16 of the threader 11 must be narrow so that it can be easily maneuvered through the center of the ponytail and then avoid the wrapped strands of hair and the elastic band used to initiate the ponytail. This will become evident from the following description of the method of creating a ponytail using the threader of the invention.

FIG. 2 illustrates the first step in creating a ponytail in which the hair is grasped at the rear of the head and an elastic band (not shown) is used to initially form the ponytail. This step is well known. In FIG. 2, a section of the hair from the underside of the ponytail is then grasped and wrapped around the elastic band until it is covered and hidden, leaving a few inches of hair free at the ends. While still holding the free ends of the hair, the threader 11 is opened slightly and inserted over the free ends of the hair as illustrated in FIG. 3. Because of the resilience of the threader 11, the open end 16 will close again allowing it to be easily inserted beneath the wrap and then down through the center of the ponytail as illustrated in FIG. 3. The narrow open end 16 minimizes the chance that the legs 12 and 14 of the threader will catch on the hair. FIG. 4 illustrates the final step in which the user grasps the open end 16 and pulls the free ends of the hair through the ponytail. This will hold the ponytail in place without the use of pins or other devices.

The threader of the invention is thus useful in producing wrapped ponytails either of the plain or braided styles. Other hair styles that start with the basic wrapped hair such as a wrapped braid, a low wrapped or high wrapped ponytail, can also be created using the threader of the invention. Thus, although the threader is very simple, it is extremely useful in producing these various hair styles.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A threading device for creating a wrapped ponytail in the hair of the user by wrapping loose ends of the hair around the ponytail near the user's head to form a wrap, said threading device comprising: a substantially U-shaped pin of smooth, resilient material comprised of two thin legs joined together to form a closed end; the legs having straight first portions diverging from the closed end, second straight portions extending from the first portions along substantially parallel lines and straight third portions converging toward each other from the second portions and terminating in an open end opposite the closed end; whereby the separation of the legs is greatest between the second portions so that the loose ends of the hair can be placed between the legs and the closed end then inserted beneath the wrap to thread the hair ends through the inside of the ponytail to hold the ponytail in place after which the threading device is removed.

2. The threading device of claim 1 in which the device is made of spring steel.

* * * * *